United States Patent [19]

Cheng et al.

[11] 4,273,670

[45] Jun. 16, 1981

[54] APPARATUS FOR AND METHOD OF REMOVING RADIOACTIVE BOTTOMS FROM AN EVAPORATOR

[75] Inventors: Peter J. Cheng, Wheaton; Jay D. Dockendorff, Downers Grove; Ernest L. Wright, Lombard, all of Ill.

[73] Assignee: HPD Incorporated, Naperville, Ill.

[21] Appl. No.: 20,642

[22] Filed: Mar. 16, 1979

[51] Int. Cl.[3] ..... G21F 9/08

[52] U.S. Cl. ..... 252/301.1 W; 159/43 R; 159/44; 159/DIG. 12

[58] Field of Search ..... 252/301.1 W; 159/DIG. 12, 43 R, 44

[56] References Cited

U.S. PATENT DOCUMENTS

| | | | |
|---|---|---|---|
| 2,538,113 | 1/1951 | Mair | 159/43 R |
| 2,991,236 | 7/1961 | Vernon | 159/DIG. 12 |
| 3,293,151 | 12/1966 | Holzer et al. | 159/DIG. 12 |
| 3,327,763 | 6/1967 | Auchapt et al. | 159/DIG. 12 |

*Primary Examiner*—Deborah L. Kyle

*Attorney, Agent, or Firm*—Merriam, Marshall & Bicknell

[57] ABSTRACT

Apparatus and methods are disclosed for removing concentrated radioactive aqueous waste from an evaporator and delivering the waste to a storage tank. The evaporator drain conduits are maintained full of feed liquor when concentrated waste is not being removed from the evaporator and feed liquor is used to rinse the conduits after the concentrated waste removal through the conduits is completed. The liquid fed through the conduits is carefully controlled by a sequencer or timer. A fast acting evaporator drain valve is used which can be rinsed by feed liquor to avoid plugging and deposition of radioactive solids in the valve.

5 Claims, 2 Drawing Figures

APPARATUS FOR AND METHOD OF REMOVING RADIOACTIVE BOTTOMS FROM AN EVAPORATOR

This invention relates to the concentration of low radioactive aqueous waste and apparatus and methods used therein. More particularly, this invention is concerned with improved apparatus for, and methods of, withdrawing concentrated radioactive aqueous waste or bottoms from an evaporator.

BACKGROUND OF THE INVENTION

The operation of nuclear reactors, especially those utilized for electric power generation, generally employs substantial amounts of water for cooling and fuel handling. This water acquires a significant amount of radioactive dissolved and dispersed solids from activation of impurities and corrosion products in the reactor. Contaminated borated waste water is also obtained from reactor letdown. Condensate polisher regenerant solutions, high conductivity floor drain streams and waste water from contaminated laundry are also sources of radioactive aqueous waste streams. These streams, and others, are collectively often referred to as radwaste streams.

Because of the substantial volume of the radwaste streams they cannot be disposed of without being substantially reduced in volume. The radwaste streams are accordingly collected, sometimes stored temporarily, and then processed to a small volume of greatly increased solids content generally called bottoms. The concentrated waste has a significant radioactive level so that it must be properly disposed of. The concentrated or waste or bottoms is, for example, solidified with a binding agent, put in strong containers, and then buried underground.

Radwaste volume reduction, or concentration, systems generally employ a steam heated forced circulation evaporator, a feed tank and a conduit for supplying low radioactive aqueous waste from the feed tank to the evaporator. During start-up of the system, the feed stream from the feed tank is supplied to the evaporator and concentrated without removal of bottoms until the solids level reaches the desired concentration. Since the feed stream rate can be as little as one-hundredth the rate at which the liquor is recirculated it is easy to maintain solids equilibrium in the evaporator. The water from the feed stream is, of course, evaporated except for the small amount which is withdrawn with the bottoms.

As the concentration of solids or bottoms increases in the evaporator, a level will be reached at which removal of bottoms becomes prudent, if not essential, to maintain evaporator efficiency. Thus, an evaporator may have a capacity of 1,500 gals. of liquor. When the concentration of solids reaches a predetermined level, such as 25% solids by weight, the liquor level is lowered, as for example 2 feet, by removal of 400 to 600 gallons of bottoms. This volume of liquor is then replaced from the feed stream, resulting in dilution of the liquor in the evaporator. Evaporation proceeds, with continuous addition of dilute radioactive waste, until the liquor again reaches the predetermined solids concentration. Bottoms can then be removed as described.

In the past, conventional piping and valves have been used to periodically drain bottoms from the evaporator and feed it to a bottoms tank for further handling and processing. The high solids content of the bottoms resulted in plugging of pipes and valves, causing shut downs and necessitating repairs. Because of the high radioactivity of the bottoms, repair work could be done remotely with suitable protection against radioactive exposure of the repairmen. Furthermore, the prior systems of removing bottoms provided no means of fully emptying the drain pipes so that the radioactive residue remaining in the pipes made it unsafe for workers to come into close proximity of the equipment. Isolation of the highly radioactive bottoms withdrawal areas of the plant was thus required, thereby limiting plant access, inspection and repair and providing an additional unsafe area.

SUMMARY OF THE INVENTION

The subject invention provides an improvement in apparatus for concentrating low radioactive aqueous waste containing dispersed and dissolved materials including a forced circulation evaporator, a feed tank, and a conduit for supplying low radioactive aqueous waste from the feed tank to the evaporator, with the improvement comprising: a fast acting drain valve in the evaporator for removing concentrated radioactive bottoms from the evaporator; a drain conduit from the drain valve to a pump; a rinse water conduit, containing a first valve, communicating with the drain conduit; a delivery conduit, from the pump to a bottoms storage tank, containing a second valve; a branch conduit, from the delivery conduit to a feed tank, containing a third valve; means operating the pump, with the drain valve closed and the drain conduit, delivery conduit and branch conduit full of rinse water, and opening the fast acting drain valve and the third valve to thereby convey the water in the said conduits to the feed tank before bottoms removed from the evaporator reach the third valve; means closing the third valve and opening the second valve to deliver the bottoms removed from the evaporator to the bottoms tank; means opening the first valve in the rinse water conduit; closing the second valve to the bottoms tank and opening the third valve to the feed tank to back flush the fast acting drain valve and dilute bottoms in the conduits and deliver the diluted bottoms to the feed tank; means closing the fast acting drain valve to discontinue removal of bottoms from the evaporator while flushing the conduits with rinse water by maintaining the first valve open and delivering the rinse water to the feed tank; and means closing the first valve, the third valve and stopping the pump with the conduits and pump full of rinse water.

The invention also provides a method of withdrawing bottoms comprising: withdrawing concentrated radioactive bottoms from an evaporator through a drain conduit and pumping it to a bottoms storage tank; continuing withdrawal of bottoms from the evaporator and smultaneously feeding an aqueous rinse stream to the drain conduit to dilute the withdrawn bottoms; pumping the diluted withdrawn bottoms to a feed storage tank; discontinuing withdrawal of bottoms from the evaporator; continuing to feed the aqueous rinse stream to the drain conduit until the stream in the drain conduit is very low in radioactivity; pumping the so further diluted stream to the feed storage tank; and discontinuing feeding the rinse stream to the drain conduit and pumping the diluted stream to the feed storage tank but maintaining the drain conduit and pump full of such diluted stream.

A further aliquot of bottoms can be subsequently removed from the evaporator by operating the pump and initiating flow of bottoms to the drain conduit, feeding the dilute stream in the drain conduit and pump to the feed tank until the bottoms nearly occupies the drain conduit, and diverting the bottoms in the drain conduit to the bottoms storage tank, and continuing the method as described.

DETAILED DESCRIPTION OF THE DRAWINGS

So far as it is practical, the same elements or parts which appear in the different views of the drawings will be identified by the same numbers.

Figure 1:
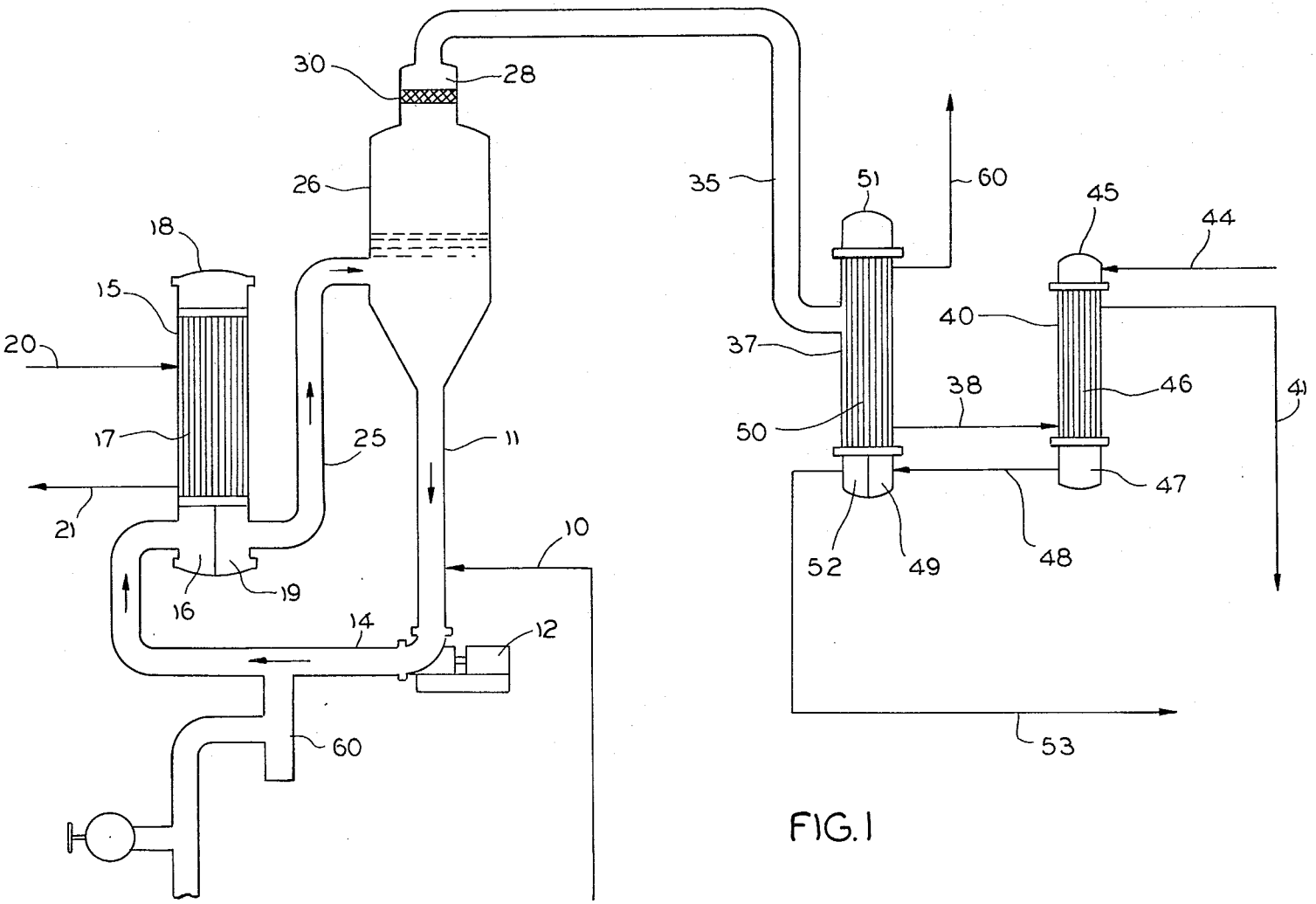
FIG. 1 illustrates apparatus used to process low radioactive aqueous waste containing dissolved and dispersed solids to a concentrated liquor.

With reference to FIG. 1, the apparatus illustrated by this drawing is representative of those used to process low radioactive aqueous waste containing dissolved and dispersed solids to a concentrated liquor, or bottoms, containing 25% by weight or more of solids. Although the subject invention pertains to an improved apparatus and method for the withdrawal of bottoms from such a representative system, a clear understanding of a source of such bottoms is believed to facilitate an understanding of the invention.

As shown in the attached drawing, an aqueous radioactive waste stream at 60° F. and 50 psia of low radioactivity and low solids, such 0.35% solids by weight, is fed at 33 gallons per minute by conduit 10 to pipe 11 which feeds the stream to recirculation pump 12. Pipe 14 conveys the stream from pump 12 to the liquor box 16 at the bottom of two-pass heater 15. The stream flows upwardly through one-half of the number of tubes 17 in heater 15 to liquor box 18 from which the stream is fed downwardly through the other one-half of the number of tubes 17 into liquor box 19. Heater 15 is supplied on the shell side with stream at 298° F. and 65 psia by conduit 20 and the condensed steam is removed by conduit 21.

The heated liquor at about 252° F. is withdrawn from liquor box 19 by pipe 25 which feeds it to vapor body 26. The liquor boils in vapor body 26 at 15 psia and 213° F., producing vapor at 16,472 pounds per hour which is fed to and through entrainment separator 28 on the top of the vapor body. The liquor is removed from the bottom of vapor body 26 by pipe 11 and is recirculated at 6000 to 8000 gallons per minute as described. After the liquor has been reduced to the desired solids concentration, which will generally be 27% solids by weight or higher, the product is removed at 218° F. from conduit 14 through ram valve 60 using the method and apparatus provided by this invention and which are described subsequently in more detail.

As the vapor flows upwardly in entrainment separator 28 it contacts mesh pad 30 which separates entrained liquid drops or mist and solids. The vapor leaves separator 28 at 213° F. and 15 psia through conduit 35 which delivers it to the shell side of condenser 37. The water formed by condensing the vapor is removed at 16,272 pounds per hour from condenser 37 by conduit 38 at 212° F. and 14.7 psia which delivers it to the shell side of subcooler 40. The cooled water or distillate which results from the vapor condensation is removed at 120° F. and 29.5 gallons per minute by conduit 41 from the shell side of subcooler 40. Conduit 41 can deliver it to any suitable destination, such as for reuse in the plant.

Cold water at 100° F. is fed by conduit 44 to water box 45 at the top of subcooler 40. The cold water flows downwardly through the tubes 46 into water box 47 at the bottom from which it flows through conduit 48 to water box 49 at the bottom of condenser 37. The water flows upwardly from water box 49 through one-half of the number of tubes 50 in condenser 37 to water box 51 at the top. The water then flows from water box 51 downwardly through the other one-half of tubes 50 into water box 52 from which the cooling water at 121° F. is removed by conduit 53.

Figure 2:
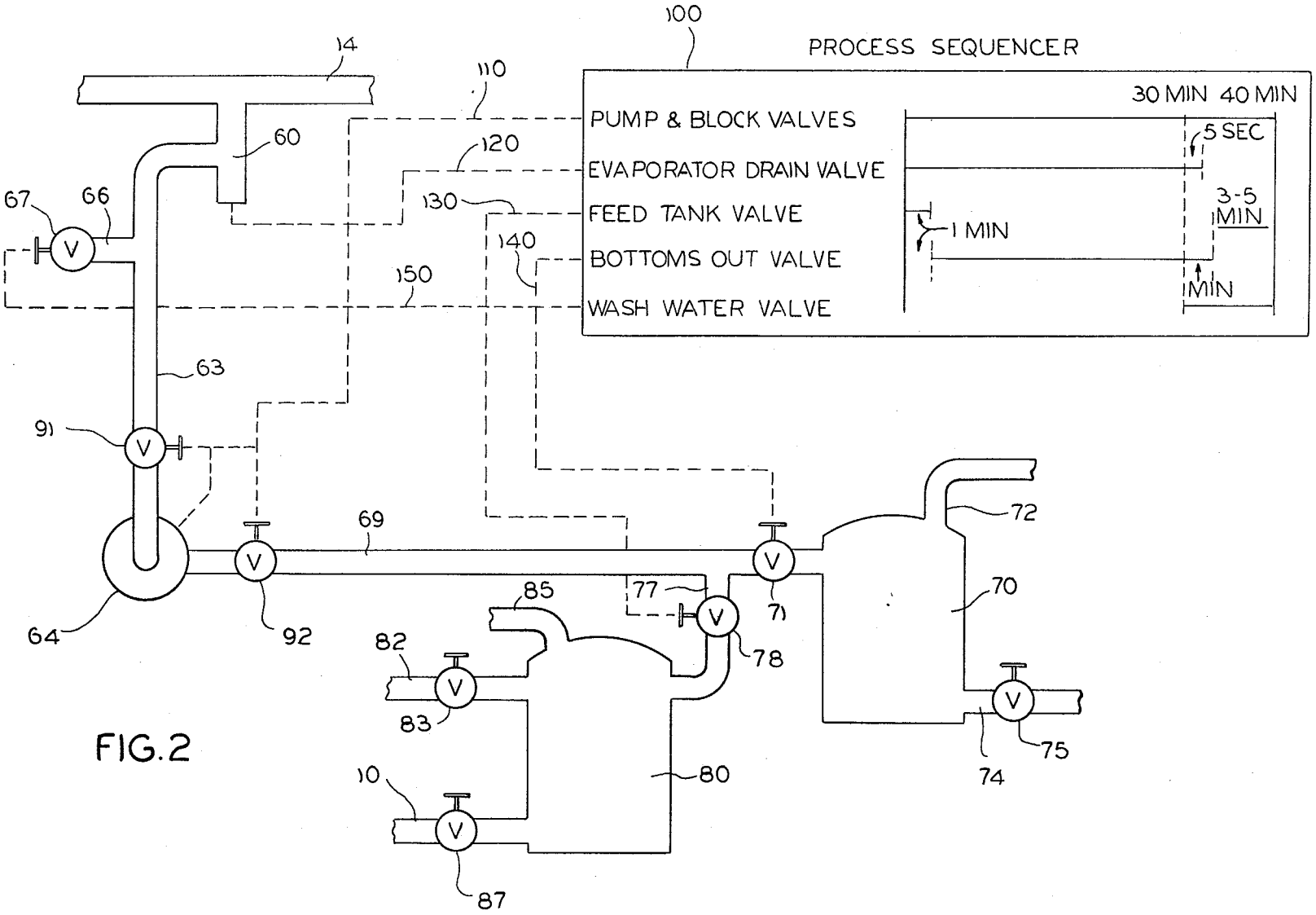
FIG. 2 illustrates apparatus according to the invention for removing bottoms from the evaporator shown in the apparatus of FIG. 1.

Withdrawal of the bottoms from the evaporator according to the invention is achieved using the apparatus shown in FIG. 2. Fast acting ram valve 60 is connected to conduit 14 and provides access thereto for removal of bottoms from the evaporator system. Extending from ram valve 60 is drain conduit 63 which communicates with pump 64. Rinse water supply conduit 66 communicates with drain conduit 63 near ram valve 60 so as to facilitate rinsing the drain conduit as will be subsequently described. A rinse water conduit valve 67 is positioned in conduit 66, desirably close to its juncture with drain conduit 63.

Extending from the outlet of pump 64 is a delivery conduit 69 which communicates with bottoms collecting tank 70. Valve 71 regulates flow of bottoms by conduit 69 to bottoms tank 70. Vent 72 in the top of tank 70 provides a means for withdrawal of separated gases which must, of course, be properly handled if they are radioactive. Conduit 74 and valve 75 provide means for removing the collected bottoms from tank 70 for subsequent disposal.

A branch conduit 77 having valve 78 therein communicates with feed tank 80. Low radioactive aqueous waste, collected from various sources, can be fed to feed tank 80 by conduit 82 through valve 83. Vent 85 in the top of feed tank 80 provides a means for removal and entry of air and other gases during filling and emptying of feed tank 80. Feed liquor withdrawal conduit 10 communicates with feed tank 80 through valve 87.

Although not an essential part of the bottoms withdrawal apparatus, it is very advisable to position a block valve 91 in drain conduit 63 upstream but close to pump 64, and to position a block valve 92 in delivery conduit 69 downstream but close to pump 64. The block valves 91 and 92 can be used to isolate pump 64 thereby permitting its removal in case of failure.

Although the apparatus as illustrated in FIG. 2 can be operated manually, it is clearly far more practical for it to be operated by automatic controls, including timers, electrically operated solenoid valves and such other conventional instrumentation as may be appropriate considering the radioactivity of the product being handled. Accordingly, the subsequent additional discussion of FIG. 2 will be as an automatic system.

When the bottoms removal apparatus illustrated by FIG. 2 is not in operation it is maintained full of rinse or wash water which can be, if desired, the low radioactive liquor fed to the evaporator.

When the density of the concentrated radioactive waste material or bottoms in the evaporator apparatus shown in FIG. 1 reaches a predetermined level, based on observation or according to a time cycle, the process sequencer 100 initiates control operations. At time zero, a 24-hour timer, which is part of the sequencer, sends a signal by line 110 which simultaneously opens block valves 91 and 92 and starts pump 64, and a signal by line 120 which opens ram valve 60 permitting bottoms to flow from conduit 14 to drain conduit 63. The 24-hour timer simultaneously also energizes a 0 to 30 minute timer and a separate 0 to 1 minute timer A. The 0–30 minute timer and timer A are part of the process sequencer. The valve 78 to the feed tank is simultaneously opened by a signal delivered to the valve by line 130.

With pump 64 running, bottoms are withdrawn from the evaporator while simultaneously the wash or rinse water initially in conduits 63 and 69 is fed to feed tank 80. Timer A then times out in about 30 seconds, causing valve 78 to close and sending a signal by line 140 to valve 71, leading to bottoms tank 70, to open.

Bottoms are removed from the evaporator for a 30 minute period, or such time as considered appropriate in view of the size of the evaporator, the concentration of the bottoms and the capacity of the bottoms withdrawal system. For a particular evaporator, a 30 minute cycle may cause the liquid level in the evaporator to drop 2 feet upon withdrawal of 400 to 600 gallons of bottoms with 2 inch diameter conduits 63 and 69.

After 30 minutes, the 30 minute timer times out and a 0 to 10 minute timer is energized. The 0 to 10 minute timer sends a signal by line 150 to wash conduit valve 67, which is thereby opened. Wash water at about 40 to 50 psig thereby flows into conduits 63 and 69 while simultaneously bottoms are back flushed from the fast acting ram valve 60 into conduit 14 for a short time, i.e. 30 seconds, due to the lower pressure (25 psig) in conduit 14. At the same time, 0 to 1 minute timer A, as well as a 0 to 1 minute timer B, which are part of the sequencer, are energized.

The 0 to 1 minute timer A times out in 30 seconds and bottoms tank valve 71 closes and valve 78 to the feed tank opens. In this way the bottoms at the front of the stream are directed to bottoms tank 70 and once that has been almost completed the flow is redirected to the feed tank which receives whatever small amount of bottoms are in the conduits as well as the conduit wash stream.

The 0 to 1 minute timer B then times out in five seconds thereby sending a signal by line 120 to close ram valve 60. Subsequently, the 0 to 10 minute timer times out resulting in a signal being sent by line 150 to close wash conduit valve 67, a signal being sent by line 130 to close valve 78 leading to the feed tank 80, and a signal being sent by line 110 to shut off pump 64 and close block valves 91 and 92. At that point, the bottoms removal cycle is completed and remains on hold, ready for the next bottoms removal at a predetermined time.

What is claimed is:

1. In an apparatus for concentrating low radioactive aqueous waste containing dispersed and dissolved materials including a forced circulation evaporator, a feed tank for holding said low radioactive aqueous waste, and a conduit for supplying low radioactive aqueous waste from the feed tank to the evaporator, the improvement comprising:

a drain valve in the evaporator for removing concentrated radioactive bottoms from the evaporator, a drain conduit from the drain valve to a pump, a rinse water conduit, containing a first valve, communicating with the drain conduit, a delivery conduit, from the pump to a bottoms storage tank, containing a second valve, a branch conduit, in communication with the delivery conduit between the pump and the second valve and extending to said feed tank, containing a third valve, means operating the pump, with the drain valve closed and the drain conduit delivery conduit and branch conduit full of rinse water, and opening the drain valve and the third valve to thereby convey the water in the said conduits to the feed tank before bottoms removed from the evaporator reach the third valve, means closing the third valve and opening the second valve to deliver the bottoms removed from the evaporator to the bottoms tank, means opening the first valve in the rinse water conduit, closing the second valve to the bottoms tank and opening the third valve to the feed tank to back flush the drain valve and dilute bottoms in the conduits and deliver the diluted bottoms to the feed tank, means closing the drain valve to discontinue removal of bottoms from the evaporator while flushing the conduits with rinse water by maintaining the first valve open and delivering the rinse water to the feed tank, and means closing the first valve, the third valve and stopping the pump with the conduits and pump full of rinse water.

2. The improvement according to claim 1 in which the drain valve is a ram valve.

3. The improvement according to claim 1 in which a block valve is located on the upstream side of the pump in the drain conduit and a block valve is located on the downstream side of the pump, but upstream of the branch conduit, in the delivery conduit, and means opening the two block valves when the pump is operating and closing the two block valves when the pump is stopped.

4. A method comprising:

withdrawing concentrated radioactive bottoms from an evaporator through a drain conduit and pumping it to a bottoms storage tank, continuing withdrawal of bottoms from the evaporator and simultaneously feeding an aqueous rinse stream to the drain conduit to dilute the withdrawn bottoms, pumping the diluted withdrawn bottoms to a feed storage tank, discontinuing withdrawal of bottoms from the evaporator, continuing to feed the aqueous rinse stream to the drain conduit until the stream in the drain conduit is very low in radioactivity, pumping the so further diluted stream to the feed storage tank, and discontinuing feeding the rinse stream to the drain conduit and pumping the diluted stream to the feed storage tank but maintaining the drain conduit and pump full of such diluted stream.

5. A method comprising:

withdrawing concentrated radioactive bottoms from an evaporator through a drain conduit and pumping it to a bottoms storage tank, continuing withdrawal of bottoms from the evaporator and simultaneously feeding an aqueous rinse stream to the drain conduit to dilute the withdrawn bottoms, pumping the diluted withdrawn bottoms to a feed storage tank, discontinuing withdrawal of bottoms from the evaporator, continuing to feed the aqueous rinse stream to the drain conduit until the stream in the drain conduit is very low in radioactivity, pumping the so further diluted stream to the feed storage tank, discontinuing feeding the rinse stream to the drain conduit and pumping the diluted stream to the feed storage tank but maintaining the drain conduit and pump full of such diluted stream, operating the pump and initiating flow of bottoms to the drain conduit, feeding the dilute stream in the drain conduit and pump to the feed tank until the bottoms nearly occupies the drain conduit, and diverting the bottoms in the drain conduit to the bottoms storage tank.

* * * * *

UNITED STATES PATENT AND TRADEMARK OFFICE

CERTIFICATE OF CORRECTION

PATENT NO. : 4,273,670

DATED : June 16, 1981

INVENTOR(S) : PETER JAMES CHENG ET AL

It is certified that error appears in the above-identified patent and that said Letters Patent are hereby corrected as shown below:

Column 1, line 35, delete the first "or"; column 2, line 55, correct the spelling of "smultaneously" to --simultaneously--; column 3, line 42, change "stream" to --steam--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*